United States Patent [19]

Takahashi

[11] Patent Number: 4,765,079

[45] Date of Patent: Aug. 23, 1988

[54] PNEUMATIC STRUCTURE

[76] Inventor: Shiro Takahashi, 1-9-20, Gohongi, Meguro-Ku, Tokyo, Japan

[21] Appl. No.: 127,220

[22] Filed: Dec. 1, 1987

Related U.S. Application Data

[63] Continuation of Ser. No. 839,885, Mar. 14, 1986, abandoned.

[30] Foreign Application Priority Data

| | | | |
|---|---|---|---|
| Apr. 3, 1985 | [JP] | Japan | 60-70200 |
| May 1, 1985 | [JP] | Japan | 60-92371 |
| Jun. 20, 1985 | [JP] | Japan | 60-134485 |
| Jun. 25, 1985 | [JP] | Japan | 60-137049 |
| Aug. 1, 1985 | [JP] | Japan | 60-168628 |

[51] Int. Cl.[4] ..... G09F 19/00; G09F 19/08

[52] U.S. Cl. ..... 40/439; 40/412; 446/178; 446/199

[58] Field of Search ..... 40/406, 412, 419, 420, 40/477, 439; 446/179, 178, 176, 199, 220, 226, 221, 361, 362

[56] References Cited

U.S. PATENT DOCUMENTS

| | | | |
|---|---|---|---|
| 2,041,737 | 5/1936 | Beal | 446/220 |
| 2,047,377 | 7/1936 | Liwschutz | 40/412 X |
| 2,348,250 | 5/1944 | Gardner et al. | 446/199 X |
| 3,071,892 | 1/1963 | Clark | 446/199 |
| 3,159,935 | 12/1964 | Rubens | 446/199 X |
| 3,377,627 | 8/1968 | Madnick | 2/158 X |
| 3,918,180 | 11/1975 | Chamberlin | 446/327 X |
| 4,271,620 | 6/1981 | Vicino et al. | 446/226 X |

FOREIGN PATENT DOCUMENTS

| | | | |
|---|---|---|---|
| 424848 | 3/1935 | United Kingdom | 40/439 |

*Primary Examiner*—Mickey Yu
*Attorney, Agent, or Firm*—Kinney & Lange

[57] ABSTRACT

A pneumatic structure a part or the whole of which can desirably be put in motion when the pneumatic structure is shaped into, for example, outlines of living things or the like. A spare portion having at least a pair of bending fulcra is formed on the structure main body on the opposite side to a bending direction of the structure, and a length of arc between the respective fulcra of the spare portion is made shorter than ½ outer circumferential length of the pneumatic structure containing a set of the respective fulcra, whereby the structure can positively be maintained in a desired state under normal conditions and bending operation thereof can be promptly effected at a large angle by means of small external force.

7 Claims, 9 Drawing Sheets

PNEUMATIC STRUCTURE

CROSS REFERENCE TO RELATED APPLICATION

This application is a continuation of my copending application Ser. No. 06/839,885, filed Mar. 14, 1986, for PNEUMATIC STRUCTURE, now abandoned.

BACKGROUND OF THE INVENTION

1. Field of the Invention

This invention relates to a pneumatic structure, and particularly to a puppet-like pneumatic structure which is filled with pressurized fluid such as air or the like to keep a certain shape, and when external force is applied thereto, the outlines of which can be changed.

2. Description of the Prior Art

A structure is generally fabricated by a rigid body, but when a material of rigid body such as metal, resin or the like is used, the costs for fabrication, transportation, installation and the like increase in the case where the fabrication of large-sized structures is intended.

Furthermore, in the case when said structure is installed for decorating, advertising or the like purpose, the installing, dismantling, and transporting operations must be repeated for a comparatively short period of time, so that the costs therefor become enormous.

Moreover, since a driving source having a large capacity and a large-scale driving mechanism are required in the case where such structure a part or the whole of which is constructed in such that it is movable, the structure becomes very expensive, besides the adjustment and maintenance therefor become also difficult. In addition, it is dangerous that one who approaches such structure in order to move the large-sized and heavy structure during the operation thereof.

In view of the above, the present inventor has already proposed a pneumatic structure which is manufactured in such that outlines (external shape) of the structure are fabricated by using a material such as cloth, film or the like through sewing work or the like as a structure main body, inflating the main body as in balloon by the use of a pressurizing means such as blower or the like to define the external shape of said structure, and further providing a simple driving means in the interior of said structure, whereby a part or the whole of the structure can be moved. Said pneumatic structure is disclosed in Japanese Laid-open Utility Model Publication Nos. 124,490/1979 and 117,788/1981, respectively.

In said Laid-open Utility Model Publication No. 117,788/1981, an operation cord is fixed at the point of a bending position and inside the outer skin defining the outlines of the structure, and used as a driving means for moving a part or the whole of the pneumatic structure.

Next, a manner for bending said structure by the use of the operation cord secured to the inside of the pneumatic structure will be described hereinbelow by referring to FIG. 28.

FIG. 28 is a schematic vertical sectional view showing a pneumatic structure having the simplest structure wherein the pneumatic structure 1 is shaped with a cloth or a filmlike material through sewing work. In the example illustrated, said pneumatic structure 1 is shaped into a substantially cylindrical form, and an end of the pneumatic structure 1 is fixed to a pedestal 2. In this condition, when air is supplied to the interior of said pneumatic structure 1 through an air hole 2A defined on said pedestal 2 along the direction of arrow Z, said pneumatic structure 1 takes the external shape (cylindrical form) as shown in FIG. 28.

As shown in FIG. 28, fittings 3 are secured to the inner wall of the pneumatic structure 1, then an operation cord 4 is fixed to said fittings 3, and when said operation cord is pulled along the direction of arrow Y, the pneumatic structure 1 is bent along the direction of arrow P.

In this case, as is apparent from FIGS. 28 and 29, a volume of the pneumatic structure after having been bent decreases remarkably in comparison with that of the pneumatic structure which has not yet been bent. As a result, such pressure inside said structure becomes suddenly high at the time of bending so that force required for the operation cord 4 increases.

Besides, the above-mentioned bending operation cannot be promptly effected.

If such pneumatic structure has a small size, it is possible to bend the structure in accordance with the manner as described above, but when a sectional area in the bending portion of said structure increases, the force required for said operation cord 4 also becomes gradually higher so that the structure cannot be actually bent.

Moreover decrease in said volume is visually apparent and as a result, appearance or impression of said pneumatic structure becomes significantly inferior.

In addition, a position to be bent cannot be fixed, more specifically an axis for bending said pneumatic structure cannot be established at a desired position.

In order to eliminate these various disadvantages, the aforesaid Laid-open Utility Model Publication No. 117,788/1981 discloses a technique wherein a spare cloth is sewed on the side opposite to that is to be bent in the pneumatic structure.

However, the technique of the just above described Laid-open Utility Model Publication has involved the following problems.

Namely, in said Publication, there is merely described a fact of adding spare cloth, but not conditions for fixing the axis for bending the pneumatic structure and the like.

In reality, if the axis of the bending is not definitely established, there is such a fear that a shape of said pneumatic structure (in either bent or upright state) is different from that had been expected, or the shape itself becomes unstable in normal conditions, i.e., where the interior of the structure has been merely filled with a pressurized fluid, and operation cord has not yet been pulled. Thus, there is a case where said structure cannot be bent by means of an operation cord or other driving means as desired.

Furthermore, when the pneumatic structure is shaped into, for example, outlines of human being, animals, imaginary living things or the like (hereinafter referred to simply as "living things or the like") and a part or the whole of said pneumatic structure must be moved, motions of said living things or the like should be more natural and enough in their power of expression. For this reason, there might be such a case where said pneumatic structure is not only bend unidirectionally, but it is required to bent the structure in differently from or opposite to said direction.

Moreover, there is also a case where such a pneumatic structure exhibiting always bending state is intended to either extend or bend in differently from or opposite to said direction.

In Japanese laid-open Utility Model Publication No. 117,788/1981, since the spare cloth is stitched to the main cloth, the stitched portion appears to be a scar when it is exposed to the surface of the main cloth and/or the bent portion is not smooth and is angular, making the appearance poor so that the quality is not sufficiently high for satisfactory use in advertisements or public exhibits.

In this respect, such technique which can respond to the requests as mentioned above has not been disclosed in said both Laid-open Utility Model Publications, and accordingly the developments thereof have been desired.

SUMMARY OF THE INVENTION

An essential object of the present invention is to provide a pneumatic structure a part or the whole of which can desirably be put in motion in the case where the pneumatic structure is shaped into, for example, outlines of living things or the like.

In order to attain the aforesaid object, the present invention contains such characteristic feature that a spare portion having at least a pair of bending fulcra is formed on the structure main body on the opposite side to a bending direction of said structure, and a length of arc between the respective fulcra of said spare portion is made shorter than ½ outer circumferential length of said pneumatic structure containing a set of said respective fulcra, whereby said structure can positively be maintained in a desired state under normal conditions, besides, a decrease in the internal volume of the structure in the case where said pneumatic structure is bent by means of external force can be comparatively suppressed, so that such bending operation can be promptly effected at a large angle by means of small force.

DETAILED DESCRIPTION OF THE PREFERRED EMBODIMENTS

Figure 1:
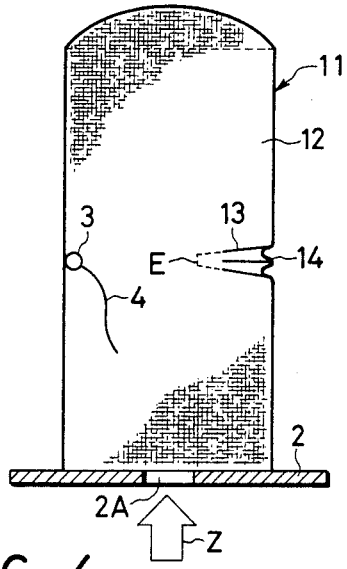
FIG. 1 is a schematic sectional view showing the first embodiment of the present invention.

The present invention will be described in detail hereinbelow by referring to the accompanying drawings. In the following respective Figures, it is to be noted that sewed line of a pneumatic structure is indicated by broken line. FIG. 1 is a schematic sectional view showing the first embodiment of the present invention, and FIGS. 2A and 2B are developments showing the pneumatic structure of FIG. 1 wherein FIG. 2A is a development of a main body 12, whilst FIG. 2B is a development of a spare cloth 14.

In FIG. 1, air has been supplied to the interior of a pneumatic structure 11 by a certain means (not shown) through an air hole 2A defined on a pedestal 2 along the direction of arrow Z, so that the pneumatic structure 11 is in an upright position and the outlines of which form a cylindrical shape in this case.

Figure 2A:
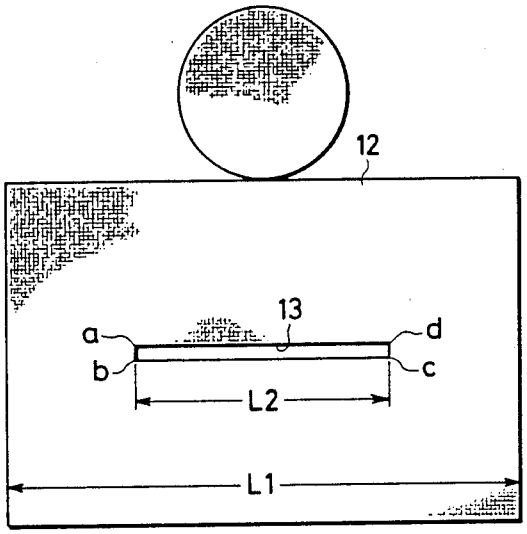
FIGS. 2A and 2B are developments each showing the pneumatic structure of FIG. 1.
Figure 2B:
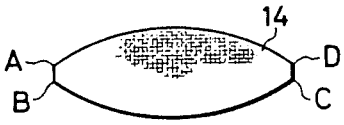

In FIGS. 2A and 2B, a margin to seam required for sewing the pneumatic structure 11 into a cylindrical shape is omitted. In other words, FIG. 2A is a flat layout.

In the respective Figures, the pneumatic structure 11 is composed of the main body 12 and the spare cloth 14 which are made of cloth coated with a resin or the like. An opening 13 having a length of L2 along the circumferential direction of said main body 12 as shown in FIG. 2A is defined thereon in the case when it is sewed into a cylindrical shape.

While said opening 13 is drawn in such that it is defined with a certain width in FIGS. 1 and 2 A , it is not limited thereto, but may be a mere cut notched.

The pneumatic structure 11 is formed by sewing the main body 12 into a cylindrical shape and further sewing the spare cloth 14 shown in FIG. 2 B to the opening 13 of said main body 12. The spare cloth 14 has a boat bottom-like shape and lengths of the respective sides of which, i.e., those of the arcs AD and BC as well as the sides AB and DC are determined so as to be equal to the respective sides of said opening 13, i.e., ad, bc and ab, dc. Said spare cloth 14 is sewed to the opening 13.

An end portion of the pneumatic structure 11 is secured to the pedestal 2 having the air hole 2A. Fittings 3 are fixed to a portion inside the main body 12 and substantially opposed to that on which the spare cloth 14 is sewed, and an operation cord 4 is fixed to said fittings 3.

While air is continuously supplied to the pneumatic structure 11, internal pressure thereof is kept constant, because said pneumatic structure 11 leaks air from the seam thereof.

In the first embodiment, length L2 (FIG.2A) of the opening 13 along the circumferential direction is established so as to be shorter than half of length L1 of the cylindrical outer circumference of the main body 12. As a result, said pneumatic structure 11 is erected by the above described air supply as shown in FIG. 1. In this situation, said spare cloth 14 is loose and folded in the form of bellows. In the following description, a portion folded or loosened in the case where no force is applied to the operation cord 4 will be referred to "spare portion". In this first embodiment, the spare cloth 14 corresponds to such spare portion.

Figure 3:
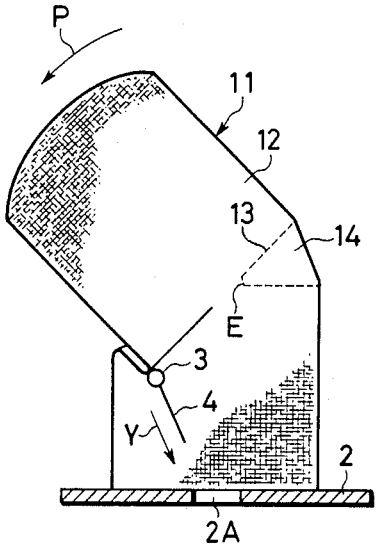
FIG. 3 is a sectional view showing a bent state of the pneumatic structure of FIG. 1.

When the operation cord 4 secured to the fittings 3 inside the pneumatic structure 11 is pulled along the direction of arrow Y as shown in FIG. 3, the spare cloth 14 is extended, and the pneumatic structure 11 is bent in the direction of arrow P around fulcra E at both ends of the spare cloth 14.

In this case, such volume of the pneumatic structure on the left side to which the fittings 3 are secured and cut with a plane passing through both the ends E of said spare cloth 14 and being in parallel to the central axis of said pneumatic structure 11 decreases, but on the contrary, the volume of the pneumatic structure 11 on the right side to which the spare cloth 14 is secured and cut with said plane increases by a volume derived from extension of the spare cloth 14.

Thus, a degree of reduction in volume of the pneumatic structure 11 extending over a state from before bending to after the bending becomes smaller than that in the case where no spare cloth 14 is provided, so that pressure increase inside the pneumatic structure 11 in case of bending is also comparatively efficiently suppressed.

Accordingly, when only small force is applied to the operation cord 4, the pneumatic structure 11 can be bent. As a consequence, it is also possible to make an angle for the bending comparatively large, besides such bending operation can promptly be effected. Moreover, since change in volume of the pneumatic structure 11 is little, the appearance or impression on spectators with respect to the pneumatic structure becomes also favorable.

Figure 4:
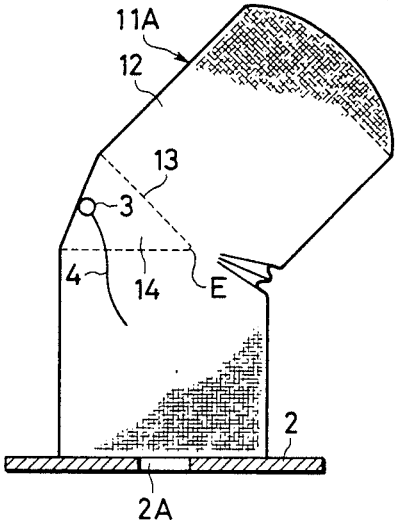
FIG. 4 is a schematic sectional view showing a modification of the first embodiment of the present invention.

FIG. 4 is a schematic sectional view showing a modification of the first embodiment of the present invention wherein like or corresponding parts are shown by corresponding reference characters in FIG. 1.

A pneumatic structure 11A shown in FIG. 4 differs from the pneumatic structure 11 shown in FIG. 1 in a ratio of length L2 of an opening 13 along the circumferential direction of said structure with respect to length L1 (FIG. 2) of the circumference of a main body 12. More specifically, although the length L2 of the opening 13 in said circumferential direction is less than $\frac{1}{2}$ with respect to the length L1 of the circumference of the main body 12 in the pneumatic structure 11 of FIG. 1, it is established that the length L2 of the opening 13 in said circumferential direction exceeds $\frac{1}{2}$ of the length L1 of the circumference of the main body 12 in the pneumatic structure 11A of FIG. 4.

When the interior of the pneumatic structure 11A having the construction as described above is pressurized, said pneumatic structure 11A is bent so as to extend a spare cloth 14 as shown in FIG. 4. Namely, in the present example, such portion of said main body 12 on the side opposite to that onto which the spare cloth 14 is fixed functions as the spare portion and which is folded in the form of bellows under normal condition.

Figure 5:
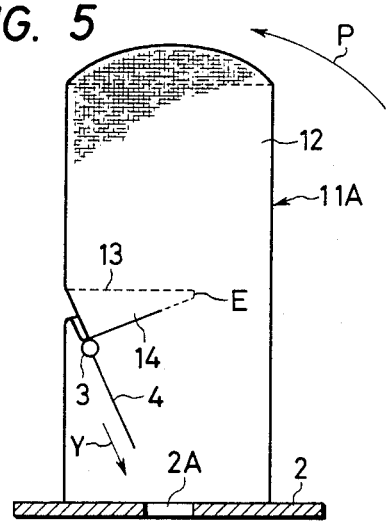
FIG. 5 is a sectional view showing an upright state of the pneumatic structure shown in FIG. 4.

When an operation cord 4 one end of which is fixed to fittings 3 attached to the inside of the spare cloth 14 is pulled along the direction of arrow Y (FIG. 5), said pneumatic structure 11A is erected in the direction of arrow P around fulcra of both ends E of the opening 13 or the spare cloth 14.

Figure 6:
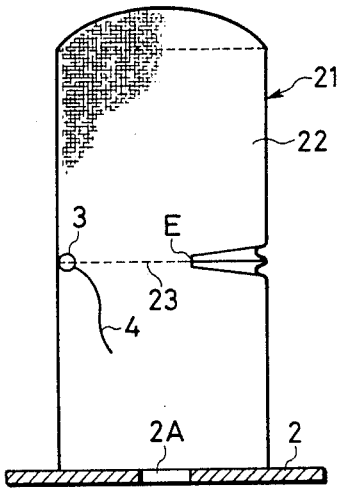
FIG. 6 is a schematic sectional view showing the second embodiment of the present invention.
Figure 7:
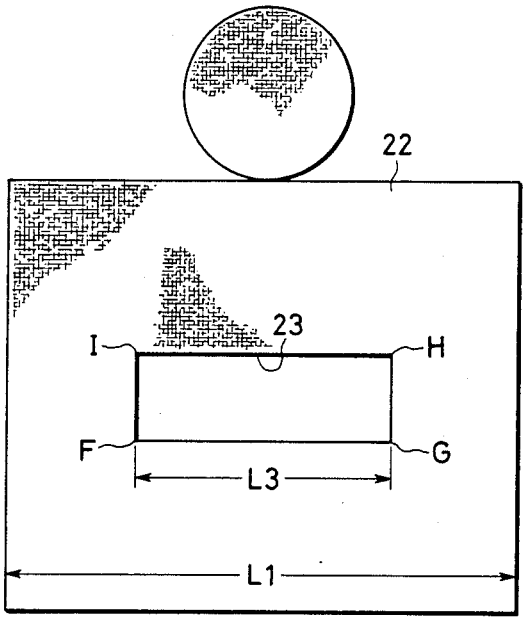
FIG. 7 is a development of the pneumatic structure shown in FIG. 6.

FIG. 6 is a schematic sectional view showing the second embodiment of the present invention wherein like or corresponding parts are shown by corresponding reference characters in FIG. 1. FIG. 7 is a development of the pneumatic structure shown in FIG. 6.

In the second embodiment, a pneumatic structure 21 is fabricated by a different manner from that for the pneumatic structure 11 shown in FIG. 1. More specifically, an opening 23 is defined on a main body 22 as shown in FIG. 7, and a pair of sides perpendicular to the axial direction of said pneumatic structure 21 are sewed together, i.e., a side extending between points I and H is sewed to a side extending between points F and G, whereby the pneumatic structure 21 is fabricated. In this case, the respective points obtained by sewing said points I and F together as well as said points H and G together correspond to both ends E of the spare portion shown in FIG. 6. In the case where length L3 of the opening 23 shown in FIG. 7 in the circumferential direction of said pneumatic structure 21 is longer than $\frac{1}{2}$ of length L1 of the circumference of the structure, the upright pneumatic structure 21 is obtained as shown in FIG. 6 when pressurized the interior thereof.

Figure 9:
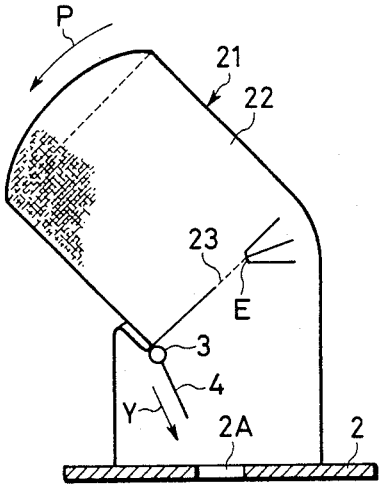
FIG. 9 is a sectional view showing a bent state of the pneumatic structure of FIG. 6.

In the present embodiment, the opposite side to the sewed-up portion of said opening 23 in the pneumatic structure 21 functions as the spare portion. When an operation cord 4 attached to fittings 3 fixed to the sewed-up portion of said opening 23 at substantially the central portion thereof is pulled along the direction of arrow Y (FIG. 9), the pneumatic structure 21 is bent in the direction of arrow P around fulcra of both ends E of said opening 23 as shown in FIG. 9.

Figure 8:
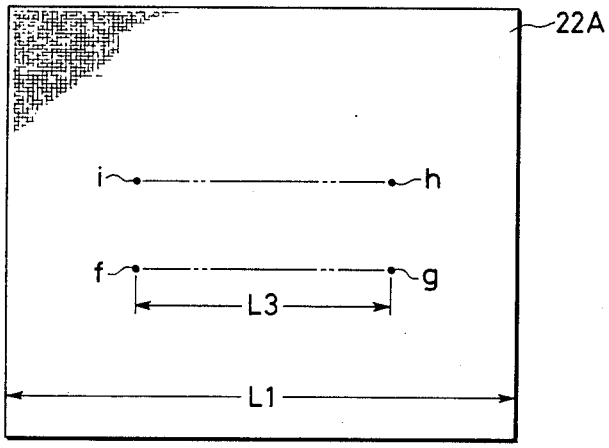
FIG. 8 is a view showing another example of a cloth for composing the main body of FIG. 7.

In the second embodiment of the present invention, the main body 22 does not necessarily involve the opening 23, but the main body 22 may be sewed together in such that a line extending between points i and h coincides with a line extending between points f and g as shown in FIG. 8.

Figure 10:
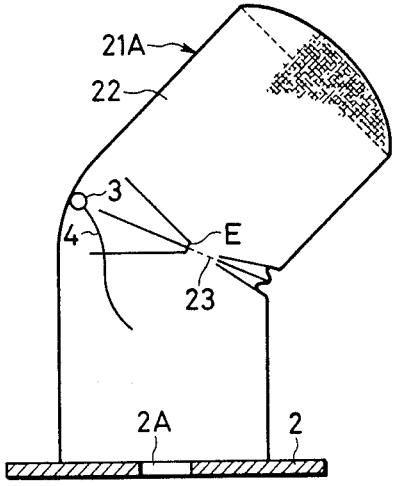
FIG. 10 is a schematic sectional view showing a modification of the second embodiment of the present invention.
Figure 11:
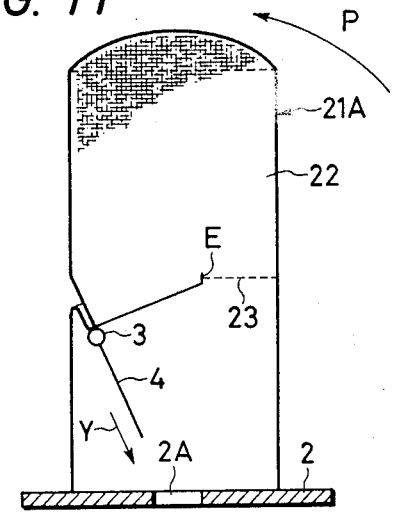
FIG. 11 is a sectional view showing an upright state of the pneumatic structure of FIG. 10.

When length L3 of said opening 23 is established in such that it is shorter than $\frac{1}{2}$ of circumferential length L1 of the pneumatic structure 21, the spare portion corresponds to the sewed-up portion of the opening 23, and a pneumatic structure 21A is bent towards the side sewed up in case of pressurizing the interior thereof as shown in FIG. 10. Furthermore, when an operation cord 4 secured to the inner wall of a portion opposite to said spare portion is pulled in the direction of arrow Y (FIG. 11), the pneumatic structure 21A is rotated around fulcra of points E along the direction of arrow P to be in upright position.

Figure 12:
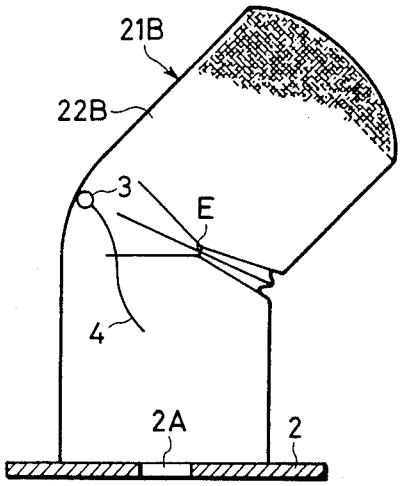
FIG. 12 is a schematic sectional view showing still another modification of the second embodiment of the present invention.

FIG. 12 shows still another modification of aforesaid second embodiment wherein a pneumatic structure 21B is formed by sewing together two portions of a cloth composing a side face of the pneumatic structure along the axial direction thereof. In other words, in the development of FIG. 8, when only two portions of the points i and f as well as the points h and g are sewed together, the pneumatic structure 21B can be obtained. In this case, it is required to establish that distance L3 between the points f and g is made either longer or shorter than ½ of a length of the circumference of said pneumatic structure 21.

Figure 13:
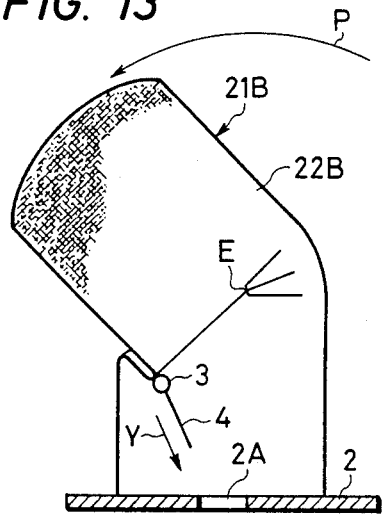
FIG. 13 is a sectional view showing a bent state of the pneumatic structure of FIG. 12 in the opposite direction thereto.
Figure 28:
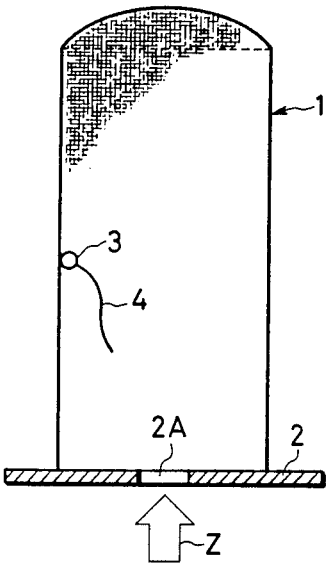
FIG. 28 PRIOR ART
FIG. 28 is a schematic sectional view showing a prior art pneumatic structure having the simplest construction.
Figure 29:
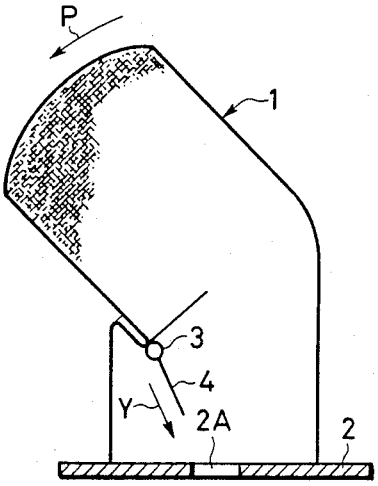
FIG. 29 PRIOR ART
FIG. 29 is a sectional view showing a bent state of the pneumatic structure of FIG. 28.

When the interior of the pneumatic structure 21B is pressurized, a spare part is formed on a portion in which a length of the circumference between the two points sewed together is shorter than ½ length of the circumference of said pneumatic structure 21B so that the pneumatic structure 21B is bent. Moreover, when the operation cord 4 mounted on a position opposed to said spare portion is pulled along the direction of arrow Y, the pneumatic structure is erected in the direction of arrow P around fulcra of the portions E sewed up, and when said cord 4 is further pulled, the pneumatic structure 21B is bent in the direction opposite to said bent direction as shown in FIG. 13.

When load on the operation cord 4 is released, the pneumatic structure 21B returns again to the state shown in FIG. 12.

Figure 14:
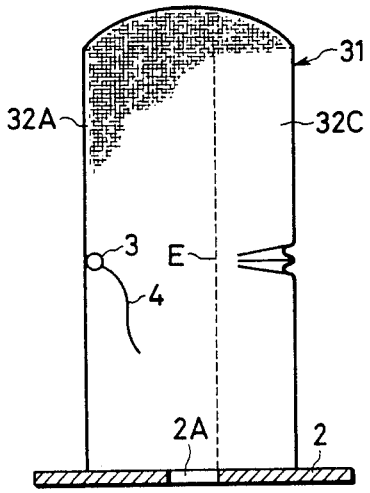
FIG. 14 is a schematic sectional view showing the third embodiment of the present invention.
Figure 15:
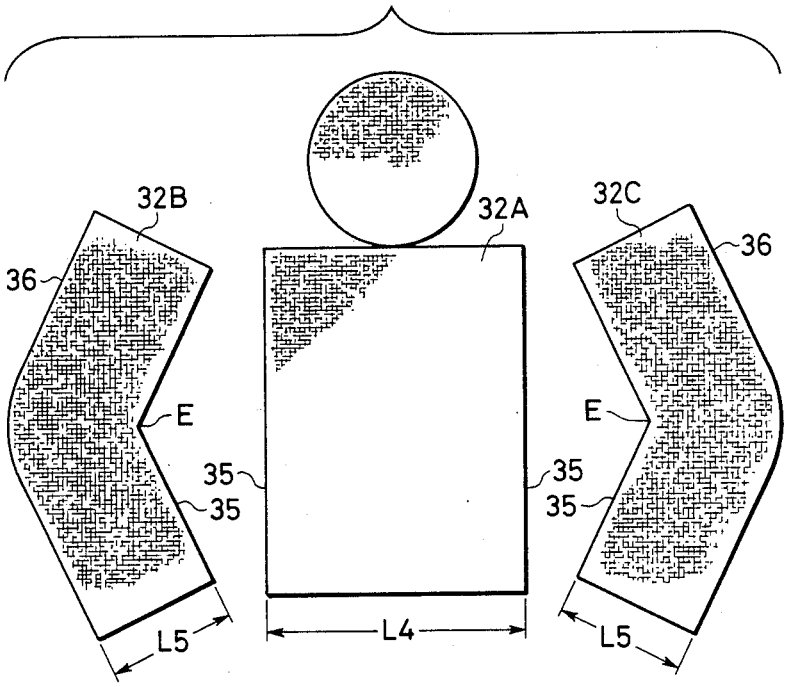
FIG. 15 is a development showing the pneumatic structure of FIG. 14.

FIG. 14 is a schematic sectional view showing the third embodiment of the present invention wherein like or corresponding parts are shown by corresponding reference characters in FIG. 1. FIG. 15 is a development of the pneumatic structure shown in FIG. 14.

In FIG. 15, cloths 32B and 32C for composing main body are symmetrical with each other and both of them are formed with a width L5. It is to be noted that lengths of each opposite sides of said main body composing cloths 32B and 32C are determined to be different from one another. More specifically, it is established in such that length of each side portion of said main body composing cloths 32B and 32C designated by reference numeral 35 are identical with that of the main body composing cloth 32A designated by the same reference numeral 35, whilst the length of each side portion of said main body composing cloths 32B and 32C designated by reference numeral 36 are longer than the length of the portion designated by reference numeral 35.

When width L4 of the main body composing cloth 32A is made longer than ½ of the circumference of the pneumatic structure and sewed up the portions of said main body composing cloths 32A, 32B and 32C each designated by the same reference numeral, respectively, a pneumatic structure 31 is erected so as to form a spare portion in said main body composing cloths 32B and 32C as shown in FIG. 14.

Figure 16:
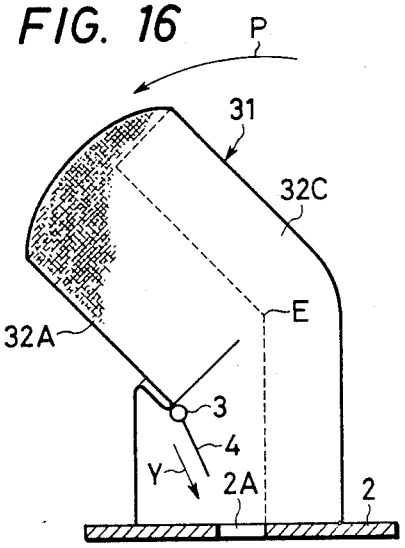
FIG. 16 is a sectional view showing a bent state of the pneumatic structure of FIG. 14.

When an operation cord 4 fixed to the inner wall of the pneumatic structure 31 so as to be opposite said spare portion is pulled along the direction of arrow Y, the pneumatic structure 3 is bent in the direction of arrow P around fulcra of bent portions E of said main body composing cloths 32B and 32C as shown in FIG. 16.

Figure 17:
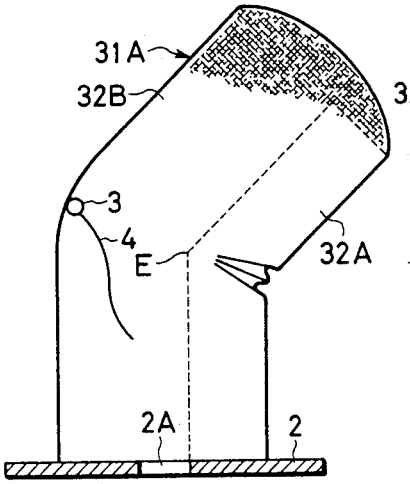
FIG. 17 is a schematic sectional view showing a modification of the third embodiment of the present invention.

In contrast with the above, if width L4 of said main body composing cloth 32A is established so as to be shorter than ½ with respect to the circumference of a pneumatic structure, this structure 31A is bent so as to form a spare portion in the main body composing cloth 32A as shown in FIG. 17.

Figure 18:
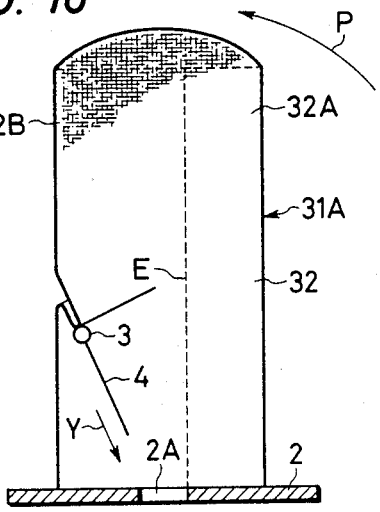
FIG. 18 is a sectional view showing an upright state of the pneumatic structure of FIG. 17.

When an operation cord 4 fixed to the inner wall of the pneumatic structure 31A so as to oppose to said spare portion is pulled along the direction of arrow Y, the pneumatic structure 31A is erected in the direction of arrow P around fulcra of bent portions E of said main body composing cloths 32B and 32C as shown in FIG. 18.

In the following description, such a manner of cutting wherein such portion corresponding to the spare cloth or the spare portion as described above is cut out so as to become integral with a cloth composing its main body will be referred to as "three-dimensional cutting".

In the above-mentioned first through third embodiments of the present invention, only a pair of fulcra for bending are disposed on the respective pneumatic structures, but the invention is not particularly limited thereto, and plural pairs of bending fulcra may be disposed along the axial direction of the pneumatic structure. Since examples in such case as described above can easily be practiced by those skilled in the art, the explanation therefor will be omitted.

Next, such pneumatic structure wherein fulcra pairs for bending are continuously disposed along the axial direction thereof will be described hereinbelow.

Figure 20:
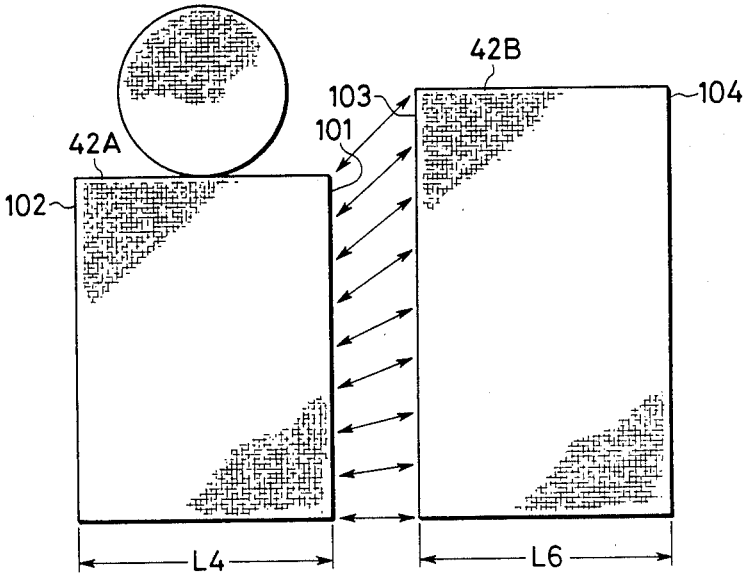
FIG. 20 is a development showing the pneumatic structure of FIG. 19.
Figure 19:
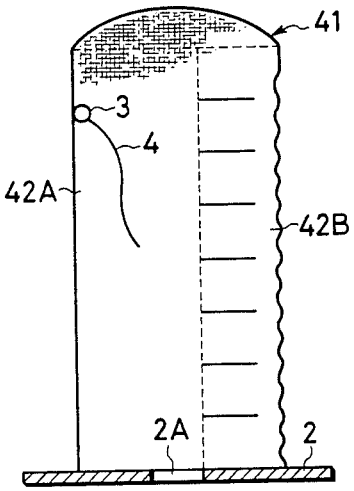
FIG. 19 is a schematic sectional view showing the fourth embodiment of the present invention.

FIG. 19 is a schematic sectional view showing the fourth embodiment of the present invention wherein like or corresponding parts are shown by corresponding reference characters in FIG. 1. FIG. 20 is a development of the pneumatic structure shown in FIG. 19.

In FIG. 20, long sides 101 and 102 of a rectangular cloth composing a side portion of a pneumatic structure in a main body composing cloth 42A are cut out with a different length from that of long sides 103 and 104 in a main body composing cloth 42B. Then, the long side 101 of the main body composing cloth 42A is sewed to the long side 103 of the main body composing cloth 42B, whilst the long side 102 of the main body composing cloth 42A is sewed to the long side 104 of the main body composing cloth 42B.

In case of the above sewing, the side edge of side 101 of the main body composing cloth 42A is sewed to the side edge of side 103 of the main body composing cloth 42B such that the portions indicated by the same arrow in the arrows shown in FIG. 20 coincide with each other. Namely, the side edge of side 101 of the main body composing cloth 42A is sewed to the side edge of side 103 of the main body composing cloth 42B so as to be wrinkled on the side 103.

Likewise, in the case where the side edge of side 102 of the main body composing cloth 42A is sewed to the side edge of side 104 of the main body composing cloth 42B, said 104 is also sewed to shorten the cloth.

When the main body composing cloths 42A and 42B are cut out in such that width L4 of said main body composing cloth 42A is longer than ½ of the circumference of its pneumatic structure, i.e., $L4 > L6$, a pneumatic structure 41 composed by means of the above described sewing is erected so as to continuously form many small spare portions on the main body composing cloth 42B as shown in FIG. 19.

Figure 21:
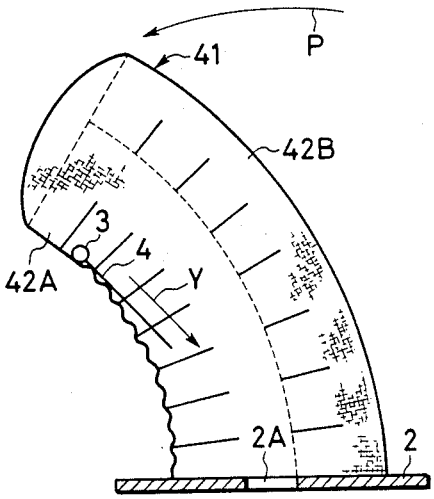
FIG. 21 is a sectional view showing a bent state of the pneumatic structure of FIG. 19.

When an operation cord 4 fixed to the top end side inside the pneumatic structure 41 and opposed to said spare portions is pulled along the direction of arrow Y, the pneumatic structure 41 is curved in the direction of arrow P as shown in FIG. 21.

Figure 22:
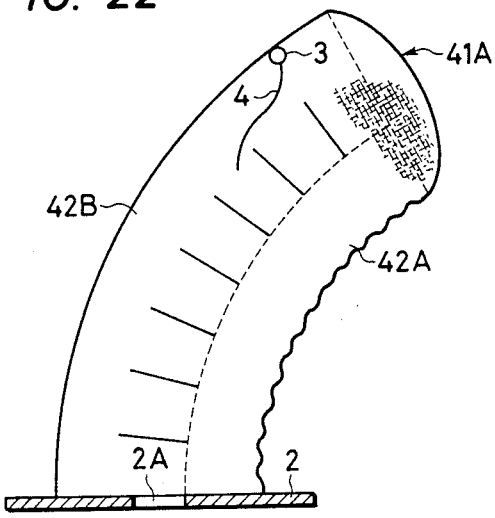
FIG. 22 is a schematic sectional view showing a modification of the fourth embodiment of the present invention.

On one hand, when the main body composing cloths 42A and 42B are cut out so as to be L4<L6 in FIG. 20, the pneumatic structure 41A is curved so as to continuously form spare portions in the main body composing cloth 42A as shown in FIG. 22.

Figure 23:
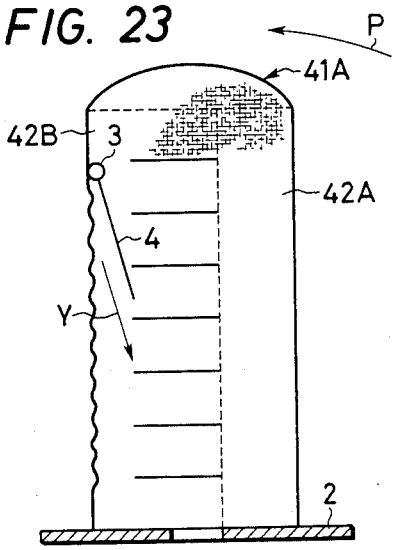
FIG. 23 is a sectional view showing an upright state of the pneumatic structure of FIG. 22.

When an operation cord 4 fixed to the top end side inside the pneumatic structure 41A and opposed to said spare portions is pulled along the direction of arrow Y, the pneumatic structure 41A is erected in the direction of arrow P as shown in FIG. 23.

Such sewing for reduction as described above is not always required, but fulcra for bending can be continuously disposed by means of three-dimensional cutting.

When a plurality of fulcra for bending are continuously or intermittently disposed in such that the positions of them differ from one another with respect to the axial direction of its pneumatic structure as mentioned above, either only one operation cord may be attached to a portion opposed to such spare portion positioned at the outermost end of said pneumatic structure, or a plurality of operation cords may be fixed to, for example, portions opposed to the respective spare portions. In addition, in case of providing a plurality of operation cords, the traction ends of said operation cords may be collected as a single member.

However, the following problems arise if a pneumatic structure involving the plural spare portions is in a cylindrical shape sections of which cut with a plane perpendicular to the axial direction are the same dimensions with each other:

(1) In the case where only one operation cord is provided to a portion opposed to such spare portion positioned at the outermost end of its pneumatic structure on the inner wall thereof, the pneumatic structure cannot be bent around the fulcra at the end portions in a desired spare portion by merely pulling the operation cord.

Furthermore, if a distance between adjacent spare portions is comparatively long, there might be such a case where the pneumatic structure may be bent only around fulcra at the end portions in such spare portion positioned at the outermost end of said pneumatic structure. In an extreme case, there is also such a fear that said pneumatic structure is entirely warped in such extent extending from the portion to which an operation cord for the pneumatic structure is fixed to the base and the neighbourhood of said pneumatic structure and more specifically, the pneumatic structure is bent around fulcra at indefinite portions other than the ends of the respective spare portions.

(2) In the case where a plurality of operation cords are provided on, for example, portions opposed to the respective spare portions on the inner wall of its pneumatic structure and further, traction ends of the respective operation cords are collected as a single member, it is required to adjust slackenings on the respective operation cords so as to successively bend the pneumatic structure extending from the end portions of the spare portion positioned at the extreme end of said pneumatic structure to the end portions of the spare portion positioned on the base side of the structure. More specifically, it is necessary for adjusting the slack of the respective operation cords in such that an operation cord one end of which has been secured to the base side of the pneumatic structure is much slackened as compared with that of an operation cord one end of which is secured to a further end of said pneumatic structure.

However, when slackening of such operation cord fixed to the base side of a pneumatic structure is excessively established, there is a case where the pneumatic structure is bent only around fulcra at the end portions of the spare portion positioned on the further end side of said structure. On the contrary, when it is established that either slack of an operation cord fixed to the further end of the pneumatic structure is larger than that of the cord secured to the base side of said structure, or the slack of each of the operation cords is equal to the other, there may be a case where the pneumatic structure is bent only around fulcra at the end portions in the spare portion positioned on the base side of said structure.

Thus, in the case where a plurality of operation cords are provided on a pneumatic structure so as to differ positions of attachment from one another with respect to the axial direction of the structure and ends of the respective operation cords are collected as a single member, slackening condition of said respective operation cords must be strictly established, so that the fabrication and adjustment therefor are very troublesome.

Besides, in this case, the pneumatic structure cannot be bent around a plurality of fulcra at the end portions of the respective spare portions at a time.

The fifth embodiment of the present invention made for solving the above described problems will be described hereinbelow.

Figure 24:
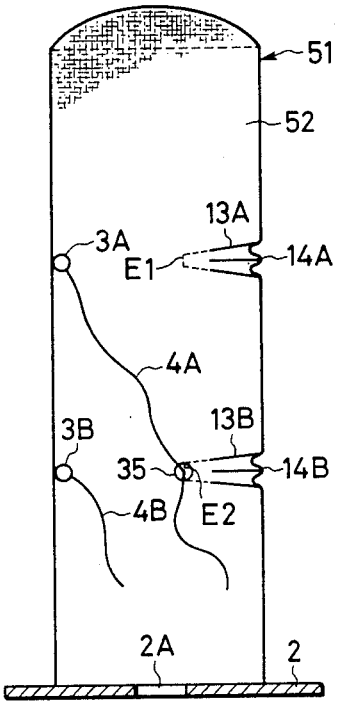
FIG. 24 is a schematic sectional view showing the fifth embodiment of the present invention.

FIG. 24 is a schematic sectional view showing the fifth embodiment of the present invention wherein like or corresponding parts are shown by corresponding reference characters in FIG. 1 and accordingly, the explanation therefor will be omitted. In FIG. 24, air is supplied to the interior of a pneumatic structure 51 through an air hole 2A defined on a pedestal 2 by means of a certain means (not shown) as is similar to FIG. 1, so that said pneumatic structure 51 is erected and shapes outlines of a cylinder in this case .

Two openings 13A and 13B are defined on a main body 52 with each length less than ½ of the circumference thereof along the circumferential direction in such that positions of said openings with respect to the axial direction differ from one another when said main body 52 is sewed in cylindrical shape.

The pneumatic structure 51 is obtained by sewing the main body 52 into cylindrical shape, and further sewing spare cloths 14A and 14B to the openings 13A and 13B of said main body 52, respectively.

Fittings 3A and 3B are secured to portions opposed substantially to those on which the respective spare cloths 14A and 14B have been sewed and inside said main body 52, and further one end of each of the operation cords 4A and 4B is fixed to each of said fittings 3A and 3B.

Inside said pneumatic structure 51, a ring supporting rod (not shown) is horizontally mounted in the neighbouring areas of a pair of end portions E2 of said opening 13B as the supporting portions. A ring 35 is engaged with said ring supporting rod. Said operation cord 4A is passed through said ring 35.

Said ring 35 and the ring supporting rod are disposed such that a contact portion of said ring 35 and said operation cord 4A is positioned either on a phantom straight line (bending axis) including a pair of the end portions E2 of said opening 13B, or in the vicinity of said straight line in the case when the interior of said pneumatic structure 51 is pressurized.

As mentioned above, since a length of each cut in the openings 13A and 13B is shorter than that of half of the cylinder outer circumference of the main body 52, said pneumatic structure 51 is erected due to the above described air supply.

Figure 25:
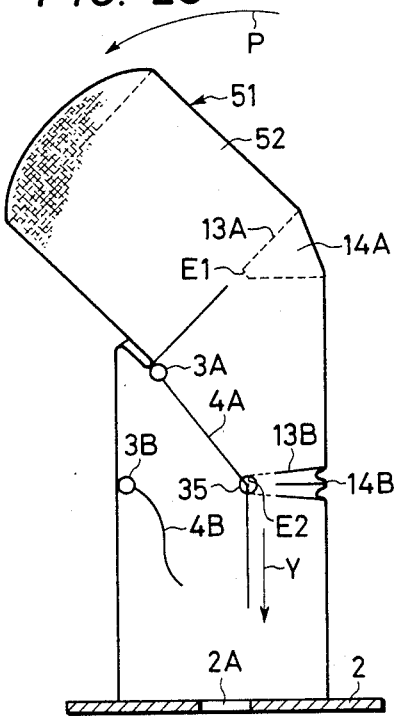
FIG. 25 is a sectional view showing a state in which the pneumatic structure of FIG. 24 is bent at fulcra E1.

When the operation cord 4A is pulled in the direction of arrow Y as shown in FIG. 25, said pneumatic structure 51 is bent along the direction of arrow P around only fulcra of E1 by means of tension of the operation cord 4A applied to the fittings 3A.

Since the traction load which acts on said fittings 3A passes through the fulcra E2, the pneumatic structure 51 does not bend around the points E2 as its fulcra.

And, when only the operation cord 4B is pulled, the pneumatic structure 51 is bent around the fulcra of E2. In this case, even if the operation cord 4B is pulled, a distance between each fulcrum E2 and the fittings 3A does not change at all, so that such bending operation of said pneumatic structure 51 around the fulcra E1 is not influenced by the movement of said operation cord 4B. In other words, each bending operation around the fulcra E1 or E2 may independently be conducted by means of loading and movement of the operation cord 4A or 4B in accordance with the fifth embodiment of the present invention.

When both the operation cords 4B and 4A are pulled with the same amounts at the same time, said pneumatic structure 51 can be bent around the fulcra E2 and E1 at substantially the same angles with each other at the same time.

As described above with respect to FIGS. 12 and 13, it is possible that such pneumatic structure bent inherently in a certain direction is erected by using one operation cord, and further said structure is bent in the opposite direction to said direction.

Figure 26:
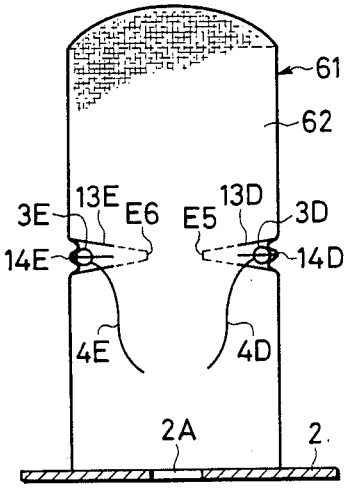
FIG. 26 is a schematic sectional view showing the sixth embodiment of the present invention.

Next, an example in which such a pneumatic structure being inherently upright position is bent in a prescribed direction or the opposite direction to said prescribed direction by using one of two operation cords. will be described hereinbelow. FIG. 26 is a schematic sectional view showing the sixth embodiment of the present invention wherein like or corresponding parts are shown by corresponding reference characters in FIG. 1.

In FIG. 26, two openings 13D and 13E are defined on a main body 62 at the positions on the circumference obtained by cutting the cylindrical main body 62 with such plane perpendicular to the central axis of the cylinder, and each length of said openings 13D and 13E being less than ½ of said circumference.

The pneumatic structure 61 is formed by sewing spare cloths 14D and 14E to said openings 13D and 13E of the main body 62, respectively.

Fittings 3D and 3E are secured to the respective spare cloths 14D and 14E inside said main body 52, and further one each end of operation cords 4D and 4E is fixed to each of said fittings 3D and 3E.

In the present embodiment, since the openings 13D and 13E are shorter than half length of the outer circumference of the cylindrical main body 62 as mentioned above, said pneumatic structure 61 is erected by blowing the air to the interior of the pneumatic structure 61.

Figure 27:
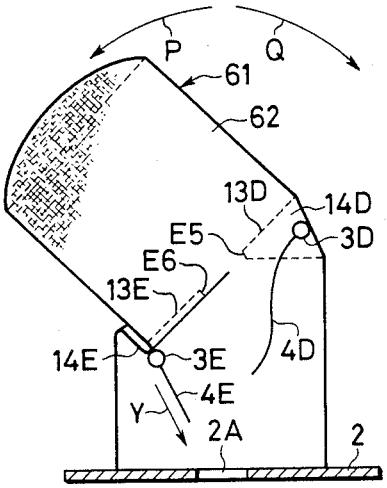
FIG. 27 is a sectional view showing a state in which the pneumatic structure of FIG. 26 is bent at fulcra E5.

In the above situation, when, for example, the operation cord 4E fixed to the fittings 3E inside the pneumatic structure 61 is pulled in the direction of arrow Y, the spare cloth 14D extends so that said pneumatic structure 61 is bent along the direction of arrow P around fulcra of both the ends E5 of the opening 13D as shown in FIG. 27.

In this condition, when ceased traction of the operation cord 4E, the pneumatic structure 61 returns again to its upright state due to the internal pressure as shown in FIG. 26.

Likewise, when the operation cord 4D fixed to the fittings 3D inside the pneumatic structure 61 is pulled, the spare cloth 14E extends so that said pneumatic structure 61 is bent along the direction of arrow Q around fulcra of both the ends E6 of the opening 13E.

In also the present embodiment, since the spare cloths 14D and 14E are provided, a degree of reduction in such volume of the pneumatic structure 61 under the condition extending from before bending to after the bending becomes small, besides the pressure increase in the interior of the pneumatic structure 61 at the time of bending may also be suppressed to a comparatively slight degree.

Thus, it is possible that the pneumatic structure 61 is bent (in a certain prescribed direction or the reverse direction thereto) at either or both the ends E5 or E6 by merely applying a small force to the operation cord 4D or 4E. Furthermore an angle for such bending may be determined with a comparatively large value. In addition, since change in volume of the pneumatic structure 61 is slight, appearance of said pneumatic structure and impression thereof upon spectators become favorable.

It has been described in relation to said fifth and sixth embodiments that the respective spare portions are formed by sewing the spare cloths to the main body, but the present invention is not particularly limited only thereto, and such spare portions may be also formed by means of sewing cloths together, sewing up cloths for reduction, or three-dimensional cutting.

While it has been described on said first through sixth embodiments that main bodies and spare cloths are made of a cloth coated with a resin or the like, the present invention is not limited to only such cloth and they may be composed of a material which does not expand and contract as much as such cloth, such as film or the like.

Furthermore it has been described that the traction or load applying means for said pneumatic structures are operation cords each one end of which is fixed to the inside of these pneumatic structures, but the traction means are not particularly limited merely thereto, and, for example, an air cylinder or the like may be used as said traction means. In addition, such pneumatic structure may be bent by pushing the outside wall thereof without providing any traction means in the above respective embodiments.

Since it is apparent that other different embodiments than those described above and extending over a wide range thereof can be made by those skilled in the art without departing from the spirit and scope of the present invention, the present invention is not limited to the specified embodiments except for the limitation in the appended claims.

As is apparent from the above description, the following advantageous effects are attained in accordance with the present invention.

(1) In a pneumatic structure the interior of which is filled with a pressurized fluid, a spare portion is provided in such that a length of arc between both ends thereof is shorter than ½ of the outer circumference of cross section in said pneumatic structure for the sake of bending it by affording force along a certain direction. Thus, a ratio in decrease of internal volume of the pneumatic structure at the time of bending, i.e., increase in internal pressure becomes not so significant that the pneumatic structure can be bent with comparatively small force, besides it is also possible to make angle of bending large, and in addition bending operation may promptly be conducted.

(2) The pneumatic structure according to the present invention relates to such type of a structure on the inside of which at least one operation cord is mounted and which is worked by operating one or more operation cords. Accordingly, the structure of the present invention is quite different from a structure such as marionette which is worked by strings (operation cords) attached to the outside thereof. In this respect, at least one operation cord is positioned inside the pneumatic structure in accordance with the present invention as described above, so that the appearance of said pneumatic structure is very fine and said structure can be worked in more natural way to vary the shape thereof into a desired form or to move the structure in a desired manner.

The spare portion that permits the attractive, low-force bending, is formed so that the spare cloth has a length parallel to the axis of the cylinder that is greater than the length of the material at the fulcra, so that the cylindrical structure can elongate in the region midway between the fulcra to permit or allow for the bending action. This can be seen in the center portions of the spare cloth 14 shown in FIG. 2B and also in the form of the invention shown in FIGS. 7 and 8, and their corresponding figures.

What is claimed is:

1. A pneumatic structure the outlines of which are cylindrically formed by filling the interior of said pneumatic structure with a pressurized fluid comprising:

at least one spare portion formed on a main body of said pneumatic structure so as to produce at least a pair of fulcra for bending on an axis between each pair of fulcra, the spare portion being kept in a folded condition when the interior of the pneumatic structure is filled with the pressurized fluid, driving means disposed on the inner surface of said main body in a portion opposed to the portion on which said spare portion is formed, and a length of arc of the main body including said spare portion and positioned between said pair of fulcra being selected to be shorter than one half of the length of the outer circumference of said structure including said respective fulcra.

2. A pneumatic structure as claimed in claim 1 wherein said driving means is an operation cord one end of which is fixed to the inner wall of said main body.

3. A pneumatic structure as claimed in claim 1 wherein the cylindrical pneumatic structure has a central axis and wherein the spare portion is formed by joining two points on the structure which are spaced in direction parallel to the axis of the cylindrically formed structure on each of two different planes passing through and parallel to the axis of the cylindrically formed structure to shorten the axial length of the structure along such radial planes.

4. A pneumatic structure as claimed in claim 1 wherein the spare portion and the main body are made of cloth.

5. A pneumatic structure as claimed in claim 1 wherein the spare portion and the main body are formed by preparing two rectangular sheets composing the main body, one of the rectangular sheets having two longer sides defined by two side edges for extension in the direction of a center axis of the structure and the other sheet having two shorter sides defined by two side edges for extension in the direction of the center axis of the structure, and sewing the longer sides to the shorter sides to form the cylindrical main body, such that the two side edges of each of the longer sides are respectively sewed to the two side edges of each of the shorter sides so as to be wrinkled along the edges of the longer sides.

6. A pneumatic structure, the outlines of which are cylindrically formed from a flexible material by filling the interior of said pneumatic structure with a pressurized fluid to define a central longitudinal axis comprising:

at least one spare portion of material formed on a main body of said pneumatic structure by joining first and second points on the structure which are spaced apart in direction parallel to the axis of the cylindrically formed structure to form a first fulcra, and by joining third and fourth points on the structure which are spaced apart in direction parallel to the axis of the structure on a different portion of the cylindrical structure to form a second fulcra to thereby shorten the axial length of the structure at each of the first and second fulcra so as to produce a pair of fulcra for bending and to form a spare portion of material that is kept at a folded condition when the interior of the pneumatic structure is filled with the pressurized fluid, a length of arc of the main body including said structure in position between said fulcra being selected to be shorter than one half of the length of the outer circumference of said structure including said respective fulcra; and driving means disposed on the inner wall of said main body in a portion opposed to the portion on which the spare portion is formed.

7. A pneumatic structure, the outlines of which are cylindrically formed by filling the interior of the pneumatic structure with a pressurized fluid comprising:

at least one spare portion of material forming a main body of said pneumatic structure, wherein the spare portions of the main body are formed by preparing two rectangular sheets composing the main body, one of the rectangular sheets having two longer sides defined by two side edges for extension in the direction of a center axis of the structure, and the other sheet having two shorter sides defined by two side edges for extension in the direction of the center axis of the structure, and sewing the longer sides to the shorter sides to form the cylindrical main body, such that the side edges of each of the longer sides of the one sheet are respectively sewed to the side edges of each of the shorter sides of the other sheet so that the longer sides of the one sheet are wrinkled along the edges of the longer sides, to form a plurality of fulcra for bending and to provide spare portions of cloth at the wrinkles, the spare portions being kept in a folded condition when the interior of the pneumatic structure is filled with the pressurized fluid, a length of arc of the main body including the spare portion in position between each pair of fulcra formed by wrinkling the edges of the longer sides, and extending between said pair of fulcra being selected to be shorter than one half of the length of the outer circumference of said structure including said respective fulcra; and driving means disposed on the inner wall of said main body in a position opposed to the portion on which the spare portions are formed.

* * * * *